US007051752B2

(12) United States Patent
Fiebig

(10) Patent No.: US 7,051,752 B2
(45) Date of Patent: May 30, 2006

(54) SAFETY CONTAINER

(75) Inventor: Klaus Dieter Fiebig, Reinbek (DE)

(73) Assignee: Dockweiler AG, Neustadt/Glewe (DE)

( * ) Notice: Subject to any disclaimer, the term of this patent is extended or adjusted under 35 U.S.C. 154(b) by 548 days.

(21) Appl. No.: 10/338,150

(22) Filed: Jan. 7, 2003

(65) Prior Publication Data

US 2003/0132257 A1 Jul. 17, 2003

(30) Foreign Application Priority Data

Jan. 11, 2002 (DE) ..... 102 00 786

(51) Int. Cl.
*B65D 83/14* (2006.01)

(52) U.S. Cl. ..... 137/212; 137/240; 137/590; 220/400.7

(58) Field of Classification Search ..... 137/212, 137/240, 590, 592, 588; 222/3, 400.7
See application file for complete search history.

(56) References Cited

U.S. PATENT DOCUMENTS 1,885,678 A * 11/1932 Boyer ..... 222/400.7
2,932,310 A * 4/1960 Koblish ..... 137/212
3,908,871 A * 9/1975 Gottwald ..... 222/400.7
4,506,815 A * 3/1985 Melas et al. ..... 222/630
4,676,404 A * 6/1987 Yamazaki et al. ..... 137/212
4,850,388 A * 7/1989 Shepherd ..... 137/212
4,919,304 A * 4/1990 Markowicz ..... 222/3
5,152,437 A * 10/1992 Klein et al. ..... 222/400.7
5,199,603 A * 4/1993 Prescott ..... 222/3
5,356,045 A * 10/1994 Parks et al. ..... 222/400.7
5,465,766 A * 11/1995 Siegele et al. ..... 137/209
6,575,193 B1 * 6/2003 Chang et al. ..... 137/558

FOREIGN PATENT DOCUMENTS

DE 35 44 260 A1 6/1987

* cited by examiner

*Primary Examiner*—John Rivell
(74) *Attorney, Agent, or Firm*—Vidas, Arrett & Steinkraus, P.A.

(57) ABSTRACT

A safety container, specifically for transporting, storing, and dispensing metallo-organic substances which is sealingly closed by a lid at the upper side wherein the lid has a closable feed port and two pipe line portions are adapted to be selectively connected to the interior of the container by means of a valve assembly, wherein a valve block is adapted to be attached to the lid via a bolted joint such that two openings of the valve block are aligned with lid openings and are in a sealed communication with each other, and that the valve block has two valve members adapted to be actuated from outside via a controller which selectively connect one each of the pipe line portions sealingly mounted on the valve block to an associated lid opening.

6 Claims, 1 Drawing Sheet

SAFETY CONTAINER

CROSS-REFERENCE TO RELATED APPLICATIONS

Not Applicable.

STATEMENT REGARDING FEDERALLY SPONSORED RESEARCH

Not Applicable.

BACKGROUND OF THE INVENTION

Metallo-organic substances which serve for doping semiconductors, for instance, are highly reactive, are mostly aggressive and also poisonous. In addition, they are receptive to contamination and, hence, may rapidly become unusable. Therefore, such substances require to be accommodated in suitable containers for transport, storage, and use so as to prevent them from inadvertently leaking out therefrom or being subjected to contamination, on the other hand.

The material of such containers usually is a high-grade steel alloy and the interior of the container has been surface-finished so that a reactive exchange with the medium received does not occur. It is known to treat the surfaces contacting the substances by electropolishing.

When in use, such a substance is delivered from the container either by generating a gas pressure via a pipe line connection to expel the substance through a second pipe line portion, or by introducing a reactive gas into the container through a pipe line portion and an immersion pipe, after which the gaseous compound will exit through the other pipe line portion and may be brought to application. The operation described requires to actuate appropriate valves. It is known to arrange valves in the pipe line portions. The pipe line portions, i.e. the lines connecting the container to the valves, pose a risk because they might be spoiled by bending because of maltreatment or effects caused by transport. If this causes cracks to form it will be no longer possible to shut them off and the toxic contents will get into the atmosphere.

It is the object of the invention to provide a safety container, particularly for transporting, storing, and delivering metallo-organic substances which drastically reduces the risk of the substance received leaking out therefrom inadvertently.

BRIEF SUMMARY OF THE INVENTION

The inventive safety container provides for a valve block which is adapted to be firmly connected to the lid by means of a bolted joint. The lid has two openings which are aligned with openings of the valve block and are adapted to be brought to a sealed connection to each other. The valve block has disposed therein two valve members which can be actuated from outside via an appropriate controller and selectively connect a pipe line piece sealingly mounted on the valve block each to an associated lid opening. Actuation may be by hand. However, it is also imaginable to actuate them via a controllable power member such as a magnet, motor or the like and to get such actuation performed automatically.

In the inventive safety container, the valves are arranged so as to be safeguarded in the valve block and, therefore, cannot come to be harmed while being handled and transported. For this reason, it will be possible to sealingly close the container at any time so that the substance cannot escape to the outside inadvertently. Although it is unavoidable for the inventive container to have its externally located pipe line portions subjected to bending and cracking this may be readily found out during use so that the vales either remain shut or may be shut to prevent more substance from exiting.

The inventive safety container allows to clean the container body, on one hand, and the valve block, on the other, separately in an appropriate way. Thus, according to another aspect of the invention, the valve block may also be flushed if a third valve is provided which includes a third controller and through which the pipe line portions may be directly connected to each other via a passage in the valve block for penetration by a flushing liquid. Extremely short paths can be provided, which permits to obtain a small dead space and, therefore, the flushing volume required is small.

Tight communication is necessary between the valve block and its openings and the lid of the container. To this end, one aspect of the invention provides that the lid and the valve block press their surfaces against each other in the area of the lid and valve block openings and that sealing rings of a hard material which have sealing edges are arranged between the surfaces and dig themselves into the surfaces. Such sealing rings which are made of ceramics or cemented carbide are known as such and are employed for extreme sealing requirements.

It is imaginable to place the valve block on the lid from top. However, a beneficial aspect provides that the lid has a step forming a relief on which the valve block is arranged with the lid openings being disposed in the upright surface of the step and the valve block being tightened against the upright surface by means of at least one locking screw which is passed through the full portion of the lid crosswise to the axis of the container. The locking screw may help achieve the desired press fit of the seal. Moreover, the screw allows to easily detach the valve block from the lid of the container.

BRIEF DESCRIPTION OF THE SEVERAL VIEWS OF THE DRAWINGS

An embodiment of the invention will be described below in more detail with reference to the drawings.

DETAILED DESCRIPTION OF THE INVENTION

While this invention may be embodied in many different forms, there described in detail herein a specific preferred embodiment of the invention. This description is an exemplification of the principles of the invention and is not intended to limit the invention to the particular embodiment illustrated.

Figure 1:
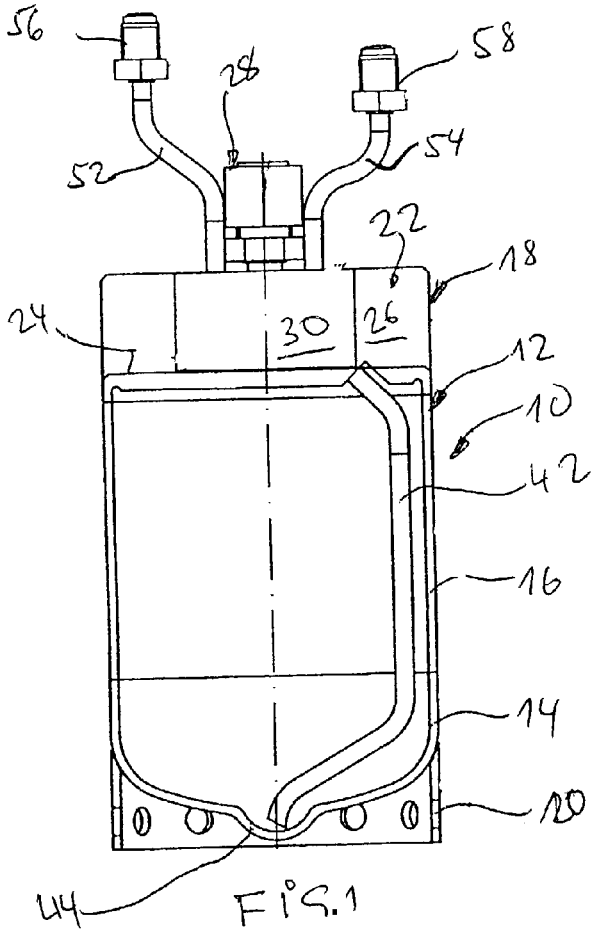
FIG. 1 shows a partial sectional side view of a safety container according to the invention where no controller and mounting of the valve members are shown.

Referring to FIG. 1, a safety container is generally outlined at 10. It has a container body 12 which has a pot-shaped bottom portion 14, a central tube-like wall portion 16, and a lid 18. The components described are formed from a high-grade corrosion resistant steel alloy and are sealingly connected to each other by an appropriate welding process. The bottom portion 14 has a ring 20 to stand on which is also fixed by welding.

The relatively thick lid 18 has a step 22 including a horizontal surface 24 and an upright or vertical surface 26. The container body 12 is cylindrical or is circular in cross-section and the lid 18 is also cylindrical or circular and is approximately of the same diameter than is the container body 12. The upright or vertical surface 26 forms a chord towards the illustrated circular shape (see FIGS. 2 and 3). Centrally mounted in the full portion of the lid 18 is a feed port not shown in detail which is adapted to be sealingly closed by means of a plug screw 28.

A valve block 30 which partially is of a cylindrical shape is placed onto the surface 24 and is pressed against the vertical surface 26 by means of two locking screw 32, 34 which are passed through cross openings in the full portion of the lid 18, i.e. by means of a flat portion 36. This is why the highly precisely finish-machined surfaces of the flat portion 36 and vertical surface 26 closely bear against each other under an adequate surface press fit. As a result, lateral openings of the valve block 30 which are not shown here are aligned with openings 38, 40 in the vertical surface 26 of the lid 18. The lid openings 38, 40 lead to the interior of the container body 12 with the opening 40 being joined to an immersion pipe 42 which is internally passed downwards within the container body 12 into a pocket 44 of the downwardly bulged bottom 14. The openings 38, 40 facing each other of the lid 18 and valve block 30 are surrounded by sealing rings 48, 50 of a very hard material which digs into the described surfaces to achieve an extremely good seal which, in addition, is inreceptive to aggressive substances.

Figure 2:
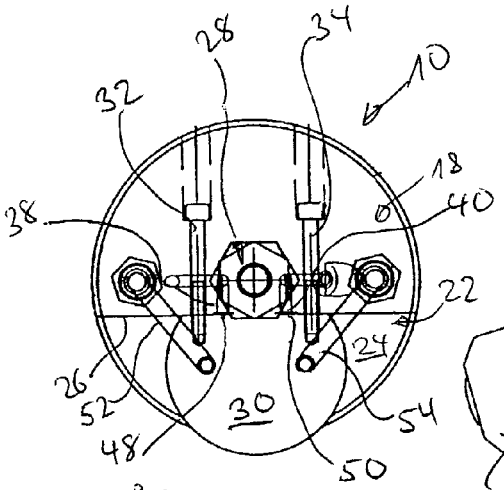
FIG. 2 shows a plan view of the assembly of FIG. 1.
Figure 3:
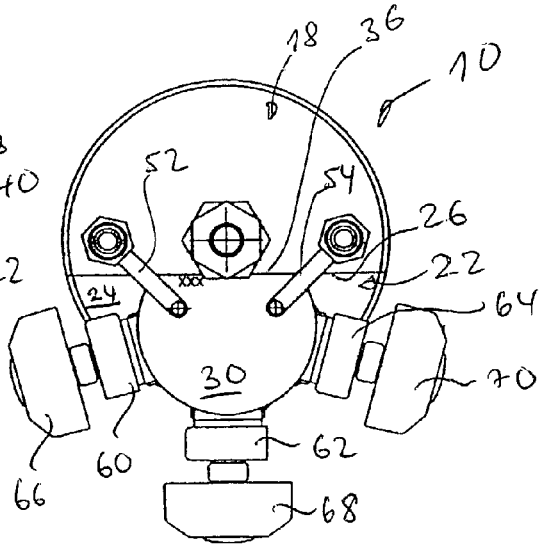
FIG. 3 shows a plan view similar to FIG. 2, but includes valve controllers and mountings for valve members.

In FIGS. 1 through 3, two pipe line portions 52, 54 can also be seen which are welded to the upper side of the valve block 30 at the lower end and have connections 56, 58 for communication with an apparatus, plant or the like which is supposed to be fed with the contents of the container 10.

Appropriate lateral openings of the valve block 30 that are not shown in the Figures are used to introduce sleeve-shaped mountings 60, 62, and 64 (FIG. 3) in which valve members, (not shown) are held and guided which are operated by appropriate actuation wheels 66, 68, and 70, respectively. The pipe line portions 52, 54, when operated by means of the actuation wheels 66, 70, are adapted to selectively communicate with the interior of the container. The actuation wheel 68, when operated, allows to establish direct communication between the pipe line portions 52, 54 via an internal passage in the valve block 30.

The modes of operation which follow are possible with the safety container shown:

If gas is introduced under a pressure into the pipe line portion 52 with the valves opened in the valve block 30 the substance from the container 10, e.g. a metallo-organic substance, passes outwardly through the line portion 54 and may be delivered to the appropriate place. Another possible way is to let flow a reactive gas, e.g. oxygen, into the container interior through the line 54 and the immersion pipe 42. The gas which is produced may then be carried outwardly through the pipe line portion 52. In the latter mode of operation, the safety container shown is also referred to as a bubbler.

Finally, when the valves are open and the flush valve is operated by means of the actuation wheel 68, a flushing medium may be passed through the pipe line portions 52, 54 and the passages inside the valve block 30 to bring about cleaning.

To clean the container, the valve block 30 is removed, which is done by simply loosening the locking screws 32, 34.

The above Examples and disclosure are intended to be illustrative and not exhaustive. These examples and description will suggest many variations and alternatives to one of ordinary skill in this art. All these alternatives and variations are intended to be included within the scope of the attached claims. Those familiar with the art may recognize other equivalents to the specific embodiments described herein which equivalents are also intended to be encompassed by the claims attached hereto.

The invention claimed is:

1. A safety container, particularly for transporting, storing, and dispensing metallo-organic substances which is sealingly closed by a lid at the upper side wherein the lid has a closable feed port and two pipe line portions are adapted to be selectively connected to the interior of the container by means of a valve assembly, a valve block being adapted to be attached to the lid via a bolted joint such that two openings of the valve block are aligned with lid openings and are in a sealed communication with each other, and that the valve block having two valve members adapted to be operated from outside via a controller which selectively connect one each of the pipe line portions sealingly mounted on the valve block to an associated lid opening the lid having a step forming a relief on which the valve block is arranged wherein the lid openings are arranged in an upright surface of the step and the valve block is tightened against the upright surface by means of at least one locking screw which is passed through the full portion of the lid crosswise to the axis of the container.

2. The safety container as claimed in claim 1, characterized in that one lid opening is joined to an immersion pipe in the container.

3. The safety container as claimed in claim 1, characterized in that the valve block contains three valves and has a third controller to selectively connect the pipe line portions directly to each other via a passage in the valve block.

4. The safety container as claimed in claim 1, characterized in that the lid and the valve block press their surfaces against each other in the area of the lid and valve block openings and that sealing rings of a hard material which exhibit sealing edges are arranged between the surfaces and dig themselves into the surfaces.

5. The safety container as claimed in claim 1, characterized in that the lid is circular and the upright surface forms a chord towards said circular shape and that the valve block is partially cylindrical with a planar, axially parallel flat portion which is tightened against the upright surface of the lid.

6. The safety container as claimed in claim 1, characterized in that the feed port is centrally provided in the lid and is adapted to be sealingly closed by a plug screw.

* * * * *